US009988894B1

(12) United States Patent
Malone et al.

(10) Patent No.: US 9,988,894 B1
(45) Date of Patent: Jun. 5, 2018

(54) SYSTEM AND METHOD FOR INSTALLING A POWER LINE IN A WELL

(71) Applicant: ACCESSESP UK LIMITED, Houston, TX (US)

(72) Inventors: David Malone, Houston, TX (US); Dwayne Leismer, Houston, TX (US)

(73) Assignee: ACCESSESP UK LIMITED (GB)

( * ) Notice: Subject to any disclaimer, the term of this patent is extended or adjusted under 35 U.S.C. 154(b) by 170 days.

(21) Appl. No.: 14/627,904

(22) Filed: Feb. 20, 2015

Related U.S. Application Data

(60) Provisional application No. 61/943,539, filed on Feb. 24, 2014.

(51) Int. Cl.

| | |
|---|---|
| ***E21B 47/02*** | (2006.01) |
| ***E21B 47/06*** | (2012.01) |
| ***E21B 47/024*** | (2006.01) |
| ***F04B 47/06*** | (2006.01) |

(52) U.S. Cl.
CPC ..... *E21B 47/024* (2013.01); *E21B 47/06* (2013.01); *E21B 47/065* (2013.01); *F04B 47/06* (2013.01)

(58) Field of Classification Search
CPC ..... E21B 43/128; E21B 23/002; E21B 7/061; E21B 47/091; E21B 47/024
USPC ..... 166/255.2
See application file for complete search history.

(56) References Cited

U.S. PATENT DOCUMENTS 4,121,657 A * 10/1978 McClure ..... E21B 47/0905 166/66
4,524,324 A * 6/1985 Dickinson, III ..... E21B 23/10 166/250.17
4,646,831 A * 3/1987 Marsh ..... E21B 17/003 166/242.6
5,996,711 A * 12/1999 Ohmer ..... E21B 7/061 166/255.2
7,325,606 B1 * 2/2008 Vail, III ..... E21B 43/128 166/250.15
9,166,352 B2 * 10/2015 Hansen ..... E21B 17/028
2002/0050361 A1 * 5/2002 Shaw ..... E21B 43/128 166/380
2003/0085815 A1 * 5/2003 Tilton ..... E21B 34/066 340/854.4
2006/0220649 A1 * 10/2006 Martinez ..... E21B 47/00 324/347
2006/0243450 A1 * 11/2006 Head ..... E21B 17/026 166/369
2008/0093069 A1 * 4/2008 O'Malley ..... E21B 17/023 166/250.01
2008/0230273 A1 * 9/2008 Brooks ..... E21B 47/024 175/45
2009/0084536 A1 * 4/2009 Kenison ..... E21B 47/024 166/66

(Continued)

FOREIGN PATENT DOCUMENTS

GB WO 2011146949 A2 * 11/2011 ..... E21B 17/028

*Primary Examiner* — Jennifer H Gay
(74) *Attorney, Agent, or Firm* — Gordon G. Waggett, P.C.

(57) ABSTRACT

System and method for installing a power line in a well. At least some of the illustrative embodiments are a powered device engaged with a power line connectable to a power supply by a power connector, and a sensor coupled to the power connector and communicatively coupled to the power line, the sensor is configured to provide data indicative of the environment in the vicinity of the power connector during installation of the power line.

21 Claims, 4 Drawing Sheets

(56) References Cited

U.S. PATENT DOCUMENTS

| | | | | |
|---|---|---|---|---|
| 2009/0242212 | A1* | 10/2009 | Shaw | E21B 43/128 166/378 |
| 2010/0243264 | A1* | 9/2010 | Tetzlaff | E21B 17/023 166/369 |
| 2010/0319911 | A1* | 12/2010 | Reid | E21B 47/024 166/255.2 |
| 2011/0272165 | A1* | 11/2011 | Zierolf | E21B 47/024 166/382 |
| 2012/0024543 | A1* | 2/2012 | Head | E21B 43/128 166/382 |
| 2012/0118563 | A1* | 5/2012 | Tetzlaff | E21B 17/028 166/242.6 |
| 2012/0222853 | A1* | 9/2012 | Head | E21B 43/128 166/65.1 |
| 2013/0062050 | A1* | 3/2013 | Head | E21B 17/028 166/105 |
| 2013/0206397 | A1* | 8/2013 | Georgi | E21B 47/09 166/250.01 |
| 2014/0020907 | A1* | 1/2014 | Head | E21B 33/0385 166/377 |
| 2014/0030904 | A1* | 1/2014 | Head | H01R 13/00 439/283 |

* cited by examiner

SYSTEM AND METHOD FOR INSTALLING A POWER LINE IN A WELL

CROSS-REFERENCE TO RELATED APPLICATIONS

The present application claims the benefit of, and incorporates by reference, U.S. Provisional Application No. 61/943,539, filed Feb. 24, 2014, and entitled "System and Method for Installing a Power Line in a Well."

FIELD OF THE INVENTION

This invention relates to a system and method for installing a power line in a well. In addition to installing power lines in wells, the present invention relates to improved ways of installing a tube with an electrical connection from the power line to a powered device located in the tube.

BACKGROUND

Electric submersible pump (ESP) systems are typically installed in oil and gas wells where reservoir pressure is inadequate to lift reservoir fluids to the surface or to increase production in natural producing wells. As a reservoir is produced, the pressure in the pore space of the rocks decreases, and thus may require the introduction of some type of artificial lift system to continue production as a reservoir or a well ages. An ESP system provides an artificial lift for a reservoir and/or well and comprises a motor to convert electrical power from a cable to mechanical power to drive the pump.

When using an ESP system, a production tube with a power line attached is typically installed into a completed well so that one or more powered device of the ESP system can be connected to the power line for a number of purposes. It is advantageous to use a remote electrical connection means (also known as a wet connector or wet connect) which permits, among other things, the removal of the powered device for replacement or repair without the necessity to remove the production tube and power line each time. Connection of a powered device to the installed power line via a wet connector may be designed to take place at any point along the length of the well but is typically positioned at the lower or furthest end of the well.

The wet connector is a sensitive electromechanical device and is arranged at the lower end of the production tube and is usually installed with the powered device to form a bottom hole assembly (BHA). This BHA is prone to damage and/or debris agglomeration during installation, particularly when deployed into a deviated or horizontal well. The wet connector arrangement typically requires a plug arm protruding into a window in the production tubing to enable it to be selectively electrically connected to the power line. This window increases the vulnerability of the wet connector as it is prone to permit access for an increase of debris accumulation in the vicinity of the wet connector.

Accordingly, when utilizing such a BHA it is useful to have reliable and accurate information concerning the position and orientation of any downhole equipment during and after installation. It is particularly important to have information about the orientation of the BHA to ensure the orientation reflects the configuration that is most reliable and least open to contaminants during operation such as pumping when it may be exposed to substantial fluid and debris movement. Sand and other debris can be produced along with the oil and gas during production. Often debris and sand will accumulate at the BHA and can damage the wet connector or will prevent the electrical connector from properly mating. Debris that is present at any point in the well may potentially damage or interfere with the mating of the connector. This debris may consist of moisture in addition to sand and grit. These substances can quite easily accumulate in the exposed orifices of the BHA, and particularly near the electrical connections of the wet connect for the supply of power to the downhole powered device. The accumulation of sand, grit and oil can cause severe disruption to the activity of the electrically powered device and may increase the likelihood of failure. The increased likelihood of disruption creates a reasonable incentive to best ensure the most reliable orientation of the BHA.

Because there is an increased accumulation of debris at the lowest point of the bore, it is preferential to orient the BHA to direct all vulnerable orifices and electrical connections upward. In the past, techniques have been developed to achieve a particular orientation of downhole completion components, including gravity oriented systems (weights), mechanically 'scribed' orientation, mule shoes (and various other mechanical placement devices) and later measurement runs on wireline to measure (and subsequently correct) the orientation of the installed completion. One such orienting technique is a process called scribing. In this process, a 'scribe line' is made down the length of the tubing in a known orientation. The line can be marked on the tubing as part of the manufacturing process or can be made on the rig as the tubing is being installed. As each tubing joint is assembled the scribe line is carefully monitored to keep track of the orientation of the scribe line at the bottom of the tubing string. As the bottom of the tubing string approaches the final depth setting the tubing string is rotated at the surface to place the scribe line in the correct position to orient the completion in the desired direction. This method is simple and inexpensive but the accuracy is poor and the opportunity for an error is very high, as small errors can accumulate and become large ones.

Other known techniques include orientation guides, mule shoes and other mechanical devices. A number of such mechanical devices have been developed that orient the tubing string as it is installed into the casing. A typical system is shown by EP 0872626. These systems have the advantage that they positively locate the tubing string axially and orient with a reliable mechanical connection. One disadvantage associated with the use of these systems is that installation of a mule shoe or other orienting device is required prior to running the casing or as a subsequent operation. Once installed, the mule shoe or orienting device may obstruct all or much of the annular space available, and the tubing or the device being oriented can become stuck in the mule shoe or its accompanying locking system. Therefore, any advance that could provide for a more reliable and protected manner of downhole orientation for ESP system components would provide a competitive advantage.

BRIEF SUMMARY

According to the invention there is provided a system for installing a powerline in a well, the system comprising a power line disposed along a tube, the power line comprising a lower end and a first power connector located in a fixed circumferential position on the tube, and arranged to be accessible for connection with a corresponding second power connector on a powered device, and a sensor provided in the proximity of and coupled to the first power connector for transmitting signals back along the power line during the installation of the power line and the tube.

The sensor preferably includes an orientation sensor which determines the circumferential orientation of the tube and hence the circumferential position of the first power connector. In response to data provided by the orientation sensor a method is contemplated to rotate the tube in horizontal or partially horizontal portions of the well so that the first power connector is maintained in the most upwardly position during installation.

According to a further aspect of the invention there is provided a method for installing a powered device in a well, comprising disposing a power line along a tube, terminating the power line in a first power connector located in a circumferential position on the tube, providing an assembly including a powered device and a second power connector, lowering the tube and power line inside the well to a desired location and rotating the tube circumferentially relatively to the well, the orientation according to data provided by an orientation sensor which detects the orientation of the tube relative to circumferential position of the well and generates a corresponding signal which is transmitted so that the first power connector is aligned upwardly in the non-vertical portions of the well during installation.

In the proposed invention an orientation measuring device or directional sensory system is provided in which the sensors may be selected from a group including but not limited to accelerometers, magnetometers, gyros, acoustic, vibrational or radiation distance sensors, or other direction sensors. The sensor may be as part of (or attached to) a retrievable electric submersible pump (ESP) completion, with the pump being the powered device. The pump and sensor system may be deployed together when the completion is being installed. The ESP completion system preferably contains an ESP cable, as part of the outer completion, which provides the ESP and sensory system with power and a path to transfer data up to the surface. The ESP inner completion systems, being the pump, motor and the inner wet connection, can be removed and reinstalled at any time. During these processes the sensor, as an integral part of the outer completion or pump can, can provide many types of useful data about the cable, wet connect and downhole environment. Information such as orientation, temperature and pressure can be valuable during installation, removal or reinstallation. Preferably the sensory system is used to provide information about the orientation of the ESP completion in real-time as it is being installed and transmits this information up to the surface via the ESP cable. The ESP cables provide a simple and reliable communication (as well as power) link between the surface and the ESP completion. Additional measurements may be added to this system to provide real-time monitoring and control of the installation process to improve efficiency and safety. In some embodiments additional sensors can be added to provide information on the fluid properties, well conditions as well as status and activation of downhole components. In some embodiments the production tubing of the ESP is installed with a wet connector with the possibility of connecting a motor post-installation.

BRIEF DESCRIPTION OF THE DRAWINGS

For a detailed description of exemplary embodiments, reference will now be made to the accompanying drawings in which.

NOTATION AND NOMENCLATURE

Figure 1:
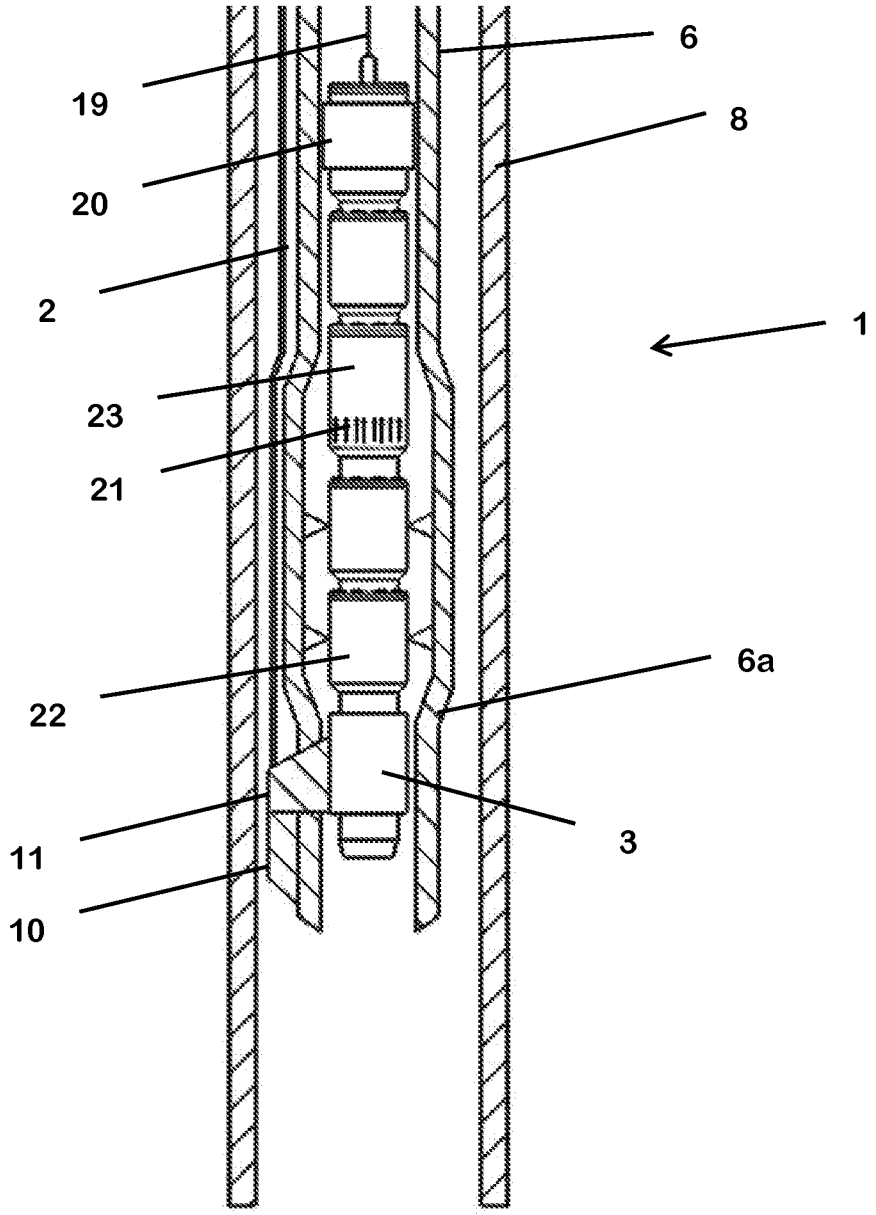
FIG. 1 shows a longitudinal cross section showing the bore hole assembly portion of the system of the invention in a well in accordance with at least some embodiments.

Certain terms are used throughout the following description and claims to refer to particular system components. As one skilled in the art will appreciate, companies that design and manufacture downhole oil and gas systems may refer to a component by different names. This document does not intend to distinguish between components that differ in name but not function.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect electrical connection via other devices and connections.

Reference to a singular item includes the possibility that there are plural of the same items present. More specifically, as used herein and in the appended claims, the singular forms "a," "an," "said" and "the" include plural references unless the context clearly dictates otherwise. It is further noted that the claims may be drafted to exclude any optional element. As such, this statement serves as antecedent basis for use of such exclusive terminology as "solely," "only" and the like in connection with the recitation of claim elements, or use of a "negative" limitation. Lastly, it is to be appreciated that unless defined otherwise, all technical and scientific terms used herein have the same meaning as commonly understood by one of ordinary skill in the art to which this invention belongs.

Where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

All existing subject matter mentioned herein (e.g., publications, patents, patent applications and hardware) is incorporated by reference herein in its entirety except insofar as the subject matter may conflict with that of the present invention (in which case what is present herein shall prevail). The referenced items are provided solely for their disclosure prior to the filing date of the present application. Nothing herein is to be construed as an admission that the present invention is not entitled to antedate such material by virtue of prior invention.

DETAILED DESCRIPTION

Before the various embodiments are described in detail, it is to be understood that this invention is not limited to particular variations set forth herein as various changes or modifications may be made, and equivalents may be substituted, without departing from the spirit and scope of the invention. As will be apparent to those of skill in the art upon reading this disclosure, each of the individual embodiments described and illustrated herein has discrete components and features which may be readily separated from or combined with the features of any of the other several embodiments without departing from the scope or spirit of the present invention. In addition, many modifications may be made to adapt a particular situation, material, composition of matter, process, process act(s) or step(s) to the objective(s), spirit or scope of the present invention. All such modifications are intended to be within the scope of the claims made herein.

In the embodiments of FIGS. 1 to 4, the ESP completion 1 is installed in the well or well casing 8 along with a large power line (ESP cable) 2 that provides electric power to the ESP system after installation. The downhole end of this power line 2 is connected to a wet connector 3, the opposite end of the power line 2 runs to a variable speed drive (VSD) 4 at the surface. The wet connector 3 comprises a first male connector 10 and a second female connector 11 which is electrically coupled to a powered device 12. As production tubing 6 is installed into the well (from tube installation means not shown), the power line 2 is spooled off of a large reel 5, and loops around an installation sheave 7 and is attached to the outside of the production tubing 6, by means of cable clamps or the like (not shown). The production tubing can either be continuous coiled tubing or jointed tubing connected together to sections. For continuous coiled tubing the power line 2 may be pre-attached to the outside of the production tubing 6.

Figure 2:
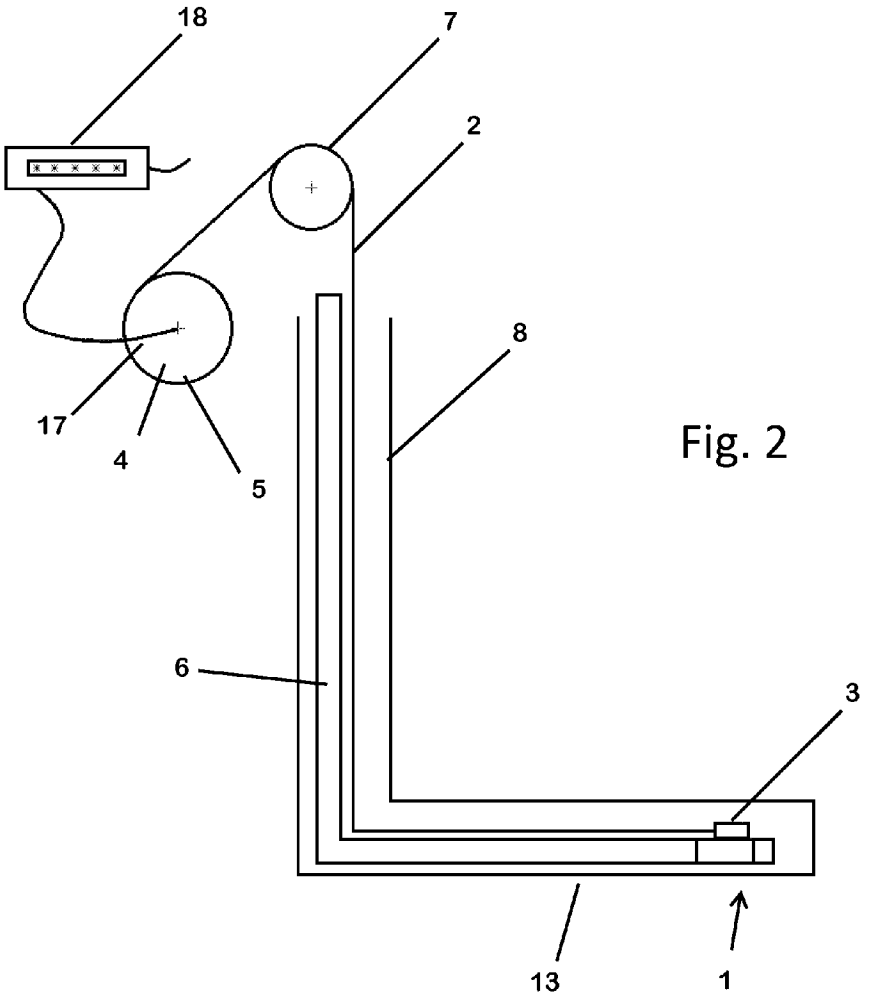
FIG. 2 shows a schematic view of a bore hole showing a general arrangement of an embodiment of the system of the invention in a well in accordance with at least some embodiments.

Referring to FIG. 1, an electric submersible pump (or ESP) comprises a number of pump modules 23, located above a number of motor modules 22, also known as ESP motors. The pumps 23 and the motors 22 are connected in series, with, in this embodiment, the pumps 23 situated upstream of the motors 22. For the purpose of ease of reference to the figures the relative positions may be referred to as above or below, showing the relation as shown in figures whereas in reality the well may well be horizontal so reference to upstream and downstream is also used. Referring to FIG. 2, the lowermost pump 23 includes a pump inlet 21 also known as an ESP housing inlet, and a pump outlet (not shown) is situated above an engageable seal 20.

The electric submersible pump is lowered down the production tithe 6 on a wireline 19 to the correct position. As the electric submersible pump nears its desired position, (orientation and trigger are provided on the production tube and the ESP, although not shown), a plug arm from the wet connector 3 extends from the electric submersible pump string to project through an opening in the permanent completion 6*a* and engage with the power line 2. The wet connector 3 and the power line 2 may mate using a known mechanism such as that described in UK patent GB2403 490, the complete disclosure of which is incorporated herein by reference.

The pump 23 and ESP motor 22 can be installed with the production tubing 6 in which case the motor is already connected to the power line 2 and the wet connector 3 is already deployed and connected. The pump 23 and ESP motor 22 may be retrieved at any later time by the wireline 19 for replacement or maintenance. The wireline 19 need not remain in place but can be deployed when required and automatically connect to the pump 23 by suitable connection means.

Figure 3:
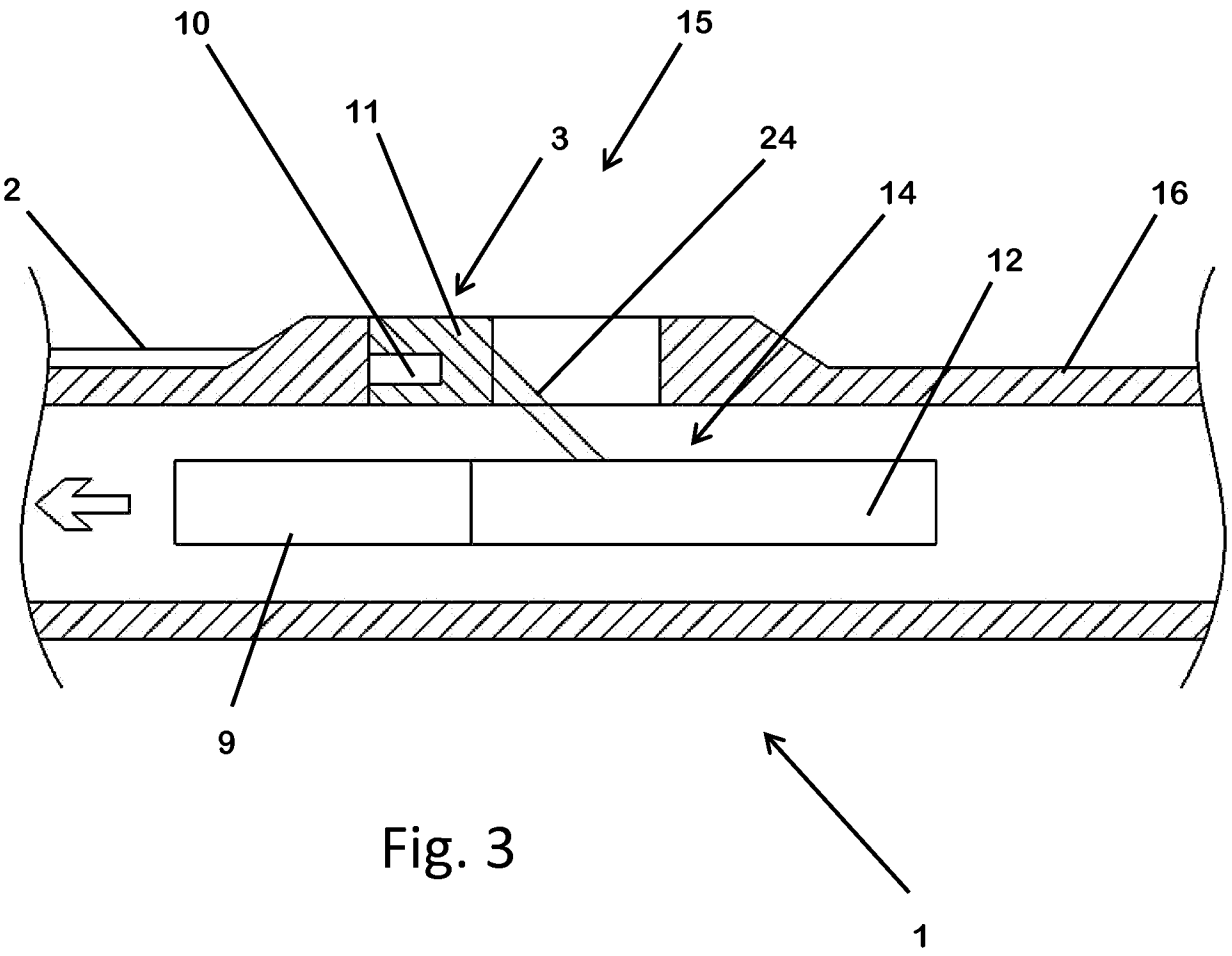
FIG. 3 shows an enlarged longitudinal section view of the lower end of the production tubing in accordance with at least some embodiments.

In a preferred embodiment as shown schematically in FIG. 3, the powered device 12, being a motor and pump, and permanent completion 6*a* and cable 2 are deployed simultaneously and is known as an ESP (electric submersible pump) completion 1. This ESP completion 1 has two key subsystems, the bottom hole assembly (BHA) or outer completion 15 and the inner completion 14. The BHA 15 consists of two primary components, the housing portion of the lower end of the production tubing, known as the pump can 16 and the male portion 10 of the wet connector 3. The wet connector 3 is a three phase electrical connector that can be mated while submerged in well fluid. The male portion 10 of the wet connect 3 is connected to the ESP cable 2 which extends to the surface.

The inner completion 14 includes the female portion 11 of the wet connector 3, the powered device 12 (i.e., the pump and motor) and the plug arm 24. Inner completion 14 may be installed simultaneously with the production tubing 6 and cable 2 or it can be installed into the BHA by deploying it through the production tubing with a wireline, slickline, coiled tubing or a tractor after the production tubing is installed. As shown in FIG. 3, the inner completion 14 includes a fishing head or other similar mechanism to allow removal of the inner completion 14 system from the BHA 15 using conventional oilfield service tools. To achieve this removal the inner completion 14 is first moved downwardly, away from the surface, left to right in FIG. 3, to disconnect the female connector 11 from the male connector 10. The plug arm 24 then automatically retracts the female connector 11 inwardly to the body of the inner completion 14, following which the entire inner completion 14 may be pulled towards the surface, from right to left in FIG. 3.

The inventors of the present specification have found a shortcoming of related-art devices in the form of variable electrical connectivity alignment and positioning between the surface power supply and the powered devices 12 based on the orientation of the wet connect 3 within the production tubing 6. In the related-art described above, orientation of the components in a tubing string, such as electrically coupled devices in an ESP system, is mechanically determined, by scribing or by the use of other mechanical features. In accordance with the various embodiments, the issues associated with the orientation of the wet connect within the production tubing are addressed, at least in part, by a system and related method which senses changes in orientation of the wet connect 3 and automatically (i.e., without human involvement at the time of the change) transmits data to the surface indicative of the position of the wet connect.

Figure 4:
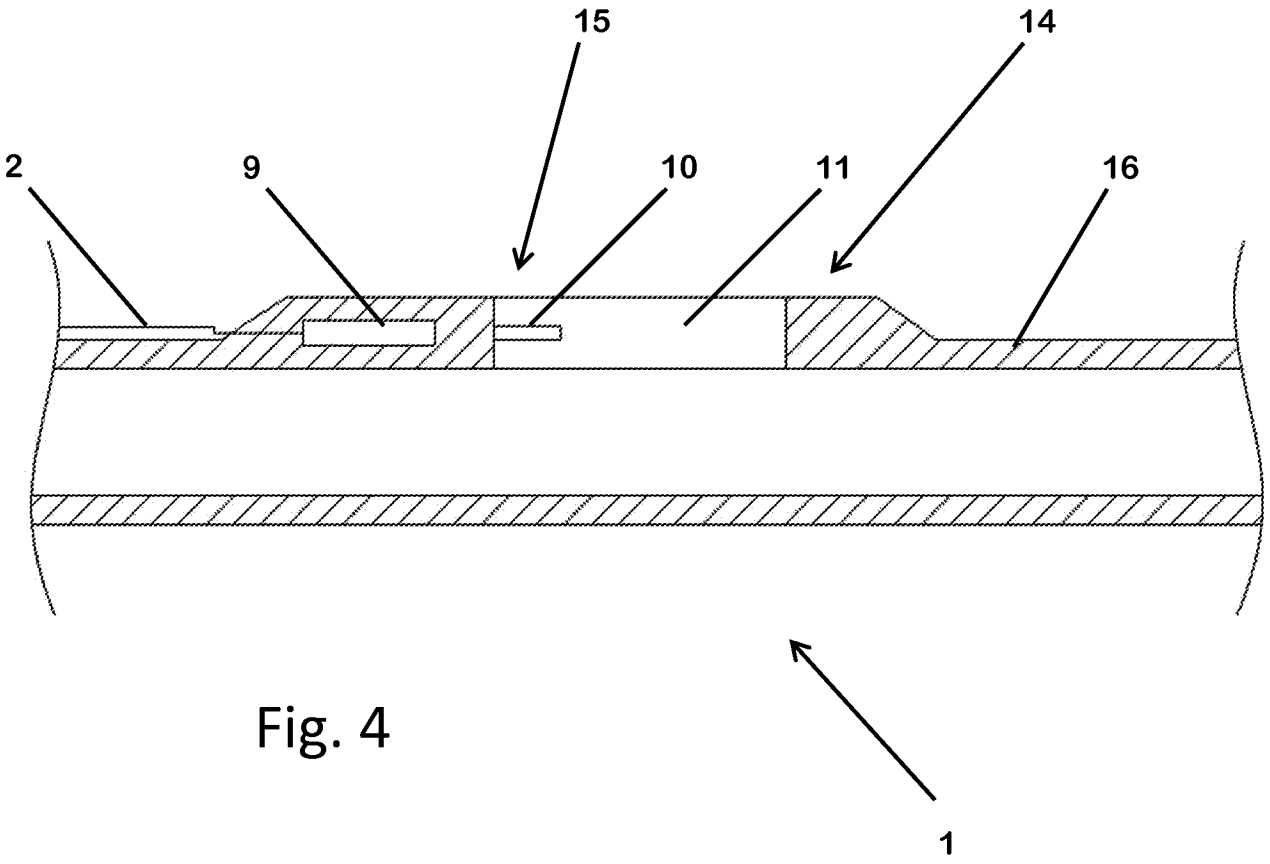
FIG. 4 shows an enlarged longitudinal section showing an alternative embodiment of the system of the invention at the lower end of the production tubing in accordance with at least some embodiments.

As shown in FIG. 4 sensor 9 is provided between the end of the power line 2 and the first wet connector 10. The sensor system 9 can be located in either the BHA 15 as shown in FIG. 4, or the inner completion 14 as shown in FIG. 3. This sensor 9 includes an orientation measuring device which remains connected to the power line 2 while the power line 2 and tubing 6 is being installed in the well. The sensor system 9 houses one or more of the following sensors and the associated electronics: accelerometers, magnetometers, gyro sensors, pressure sensors, casing collar locators, fluid property sensors, temperature sensors, current sensor, inclinometer, and/or gyroscope. For example when utilized to sense an orientation of the wet connect, the orientation sensor may take many forms. In some example systems the sensor 9 is an inclinometer that provides analog and digital values indicative of the relative positions of the wet connect 3 and the production tube 6. However, using an inclinometer as the orientation sensor 9 may not provide the ability to sense elevation changes (with constant inclination) or sense rotational orientation changes. Thus, in other example systems the orientation sensor 9 may be implemented with a digital gyroscope. Using a three-axis gyroscope the system may be able to sense not only changes in inclination of the wet connect 3, but also sense changes in elevation of the wet connect 3—that is, sense changes in all three spatial directions. In yet further embodiments the orientation sensor 9 may be a six-axis gyroscope, which is a device that implements a three-axis gyroscope as well as a corresponding three-axis accelerometer. By combining the readings of the gyroscope and accelerometer, more accurate measurements of orientation may be provided.

The sensor system 9 could be located above or below the wet connector 10, that is to say either closer to the surface or further from the surface. As the tubing 6 and power line 2 are installed into the well this orientation measuring device 9, which remains connected to the power line 2, transmits data indicative of the orientation (along with other desired data and measurements) to the surface acquisition system 18 through the power line 2 as it is being spooled into the well. For example, orientation sensor 9 may be communicatively coupled to data acquisition system 18 by way of conductors associated with power line 2. There are a variety of communicative coupling scenarios possible with respect to acquisition system 18 and sensor 9, which depend in part on the type of sensor used. For example, in some cases the communication from the sensor may be by way of analog signal, in which case the system would comprise electrical connection to an analog-to-digital input (not specifically shown). In other cases, the communication between the sensor 9 and the acquisition system 18 may be a digital serial communication. Regardless of how the acquisition system 18 and sensor 9 are communicatively coupled, by reading data indicative of the environment in the vicinity of the sensor 9 the acquisition system 18 may provide data and information regarding the status of the BHA 15.

This data provides a continuous measurement of the orientation of the tubing 6 (and the associated components mounted to the tubing) so that they can be accurately placed in the desired orientation in addition to providing data relevant to other diagnostic and fluid/well/reservoir measurements. Thus in the horizontal part of the well as shown in FIG. 2 the production tubing 6 can be orientated such that the first connection means 10 is in an uppermost position in the well and therefore is out of the way of any debris that may have accumulated in the horizontal portion of the well and resting on the lowermost part 13 of the horizontal portion of the well. By sensing and processing data from sensor 9 indicative of the orientation of the wet connect 3, it is therefore possible to install and set the BHA 15 in a particular orientation to avoid debris or obstruction. Usually, if the BHA 15 is installed in a horizontal well it is very desirable to run the BHA 15 with the wet connector 3 towards the "top side" of the hole (zero degree tool face) and to set the BHA 15 with the wet connector 3 to the uppermost "high" side of the hole. Data from sensor 9 can provide information to the surface that the wet connector 3 is indeed positioned in the desired orientation.

Similarly when the inner completion 14 is to be installed it is lowered, or otherwise urged to the desired position in the production tubing, precise alignment of the inner completion 14 to the BHA 15 is achieved both radially and longitudinally by means of the data acquired from sensor 9. Specifically, orientation data is provided to orient the sensor 9 to the desired circumferential position. The inner completion 14 may include other components such as gauges, packers, safety valves, etc., which can be aligned with the BHA 15 during installation of the inner completion 14. By collecting and utilizing sensor data from the orientation device 9 to manage the orientation of the BHA 15, the system enables a user to monitor and position other sensitive or delicate completion components and adjust these components so that they are oriented along with the BHA 15.

Upon gathering data that indicates the system is positioned in the desired orientation, the plug arm 24 extends outwardly and aligns the wet connect 11, permitting establishment of electrical continuity with the male wet connector 10 of the power line 2. The wet connect/orientation system could also include electronic circuits to interface between the ESP cable and the sensor package before physical electrical connection is complete. Alternatively, or additionally a mechanism can be provided (not shown) to allow connection/disconnection of the sensor 9 from the inner completion 12, so it can be installed and retrieved from the inner completion 12 using slickline, coiled tubing, tractors, sucker rods or other retrieval methods at any time before, during or after installation of the production string and BHA 15.

In the embodiment shown in FIG. 3 the sensor package 9 and wet connect/orientation unit are installed into the BHA 15 (this installation can take place at any time due to the availability of the wet connect). The sensor 9 measures the orientation of the BHA 15 and, depending on the configuration of the various possible types of sensors included, it can also include measurements of the down-hole pressure, fluid content, temperature or other diagnostic measurements. This information passes through the wet connect/orientation unit and the wet connector to the power line 2. It is then passed through the power line 2 until it reaches the surface and is provided to the acquisition system 18 for processing, display, and other forms of data usage by the user.

Alternatively, the sensor 9 can be mounted inside the BHA 15 housing on a permanent basis as shown in FIG. 4. The sensor 9 can measure and transmit data to the surface through the power line 2. The data can include orientation of the BHA 15 (measured using accelerometers, magnetometers or other directional sensors), intake and discharge pressure of the pumping system, temperature of the motor winding, fluid property sensors, annular pressure sensors, vibration and other measurements to improve system efficiency, provide reservoir control and to assist with diagnostics of problems with the system. This system could also be used to control and sense the position of downhole valves to provide pressure control during and after deployment. Furthermore, this system may be used to detect damage to power line 2 before deployment of motor 22. In this configuration, sensor 9 may comprise a current sensor located to detect a nominal current value associated with energy delivered through power line 2, and thereby confirm whether power line 2 is free of damage or an electrical short prior to deploying and electrically coupling motor 22 to power line 2.

While preferred embodiments of this disclosure have been shown and described, modifications thereof can be made by one skilled in the art without departing from the scope or teaching herein. The embodiments described herein are exemplary only and are not limiting. Because many varying and different embodiments may be made within the scope of the present inventive concept, including equivalent structures, materials, or methods hereafter though of, and because many modifications may be made in the embodiments herein detailed in accordance with the descriptive requirements of the law, it is to be understood that the details herein are to be interpreted as illustrative and not in a limiting sense.

What is claimed is:

1. A pumping system for pumping well fluid through a production tube in a borehole, comprising:

an electric submersible pump assembly including a motor and a pump, the pump having an inlet and an outlet;

wherein the motor is electrically connected to a power supply by a power line, wherein the power line and comprises a first electrical connector located in a fixed position on the production tube;

wherein the motor comprises a second electrical connector; and a sensor disposed adjacent to the first electrical connector, the sensor electrically and communicatively coupled with the power line, wherein the sensor comprises an orientation sensor, readings from the orientation sensor indicative of an orientation of one of the first electrical connector and the second electrical connector.

2. The pumping system of claim 1, wherein the orientation sensor is at least one selected from the group consisting of: an inclinometer; a gyroscope; a three-axis gyroscope; a six axis-gyroscope.

3. The pumping system of claim 1, wherein the sensor is disposed between a lower end of the power line and the first electrical connector.

4. The pumping system of claim 1, wherein the sensor is at least one selected from the group consisting of: a pressure sensor; a temperature sensor; a vibration sensor; a fluid property sensor.

5. The pumping system of claim 1, wherein the sensor is electrically connected to the first electrical connector.

6. The pumping system of claim 5, wherein the sensor is removable connected to the first electrical connector.

7. A downhole powered device system for use in production tubing located within a borehole comprising:

a powered device;

a power line connectable to a power supply by a power connector; the power line being located within the borehole outside of the production tubing;

an orientation sensor mechanically coupled to the power connector, and the orientation sensor communicatively coupled to the power line;

wherein the orientation sensor is configured to provide an indication of the orientation of the power connector.

8. The downhole powered device system of claim 7, wherein the orientation sensor is an inclinometer configured to provide an indication of the orientation of the power connector relative to a production tubing.

9. The downhole powered device system of claim 7, wherein the orientation sensor is a gyroscope configured to provide an indication of changes in orientation of the power connector.

10. The downhole powered device system of claim 7, wherein the orientation sensor is a three-axis gyroscope configured to provide an indication of changes in orientation of the power connector.

11. The downhole powered device system of claim 7, wherein the orientation sensor is a six-axis gyroscope configured to provide an indication of changes in orientation of the power connector.

12. The downhole powered device system of claim 7, further comprising a second sensor, wherein the second sensor is at least one selected from the group consisting of: a pressure sensor; a temperature sensor; a vibration sensor; a fluid property sensor; a current sensor.

13. The downhole powered device system of claim 12, wherein the second sensor is communicatively coupled to the power line.

14. The downhole powered device system of claim 12, wherein the second sensor is disposed adjacent to the powered device.

15. A method for monitoring downhole properties comprising:

inserting a production tubing and a power line into a well, wherein the power line has a first electrical connector disposed at a first position;

inserting a powered device through the production tubing, wherein the powered device has a second electrical connector coupled to the powered device in a first orientation for electrically connecting to the first electrical connector;

sensing the orientation of the electrical connectors by a data acquisition system; and while inserting the powered device and the production tubing, adjusting the orientation of the production tubing to a desired position by manipulation of the production tubing at the surface.

16. The method of claim 15 further comprising sensing a change in orientation of the first electrical connector to a second position different from the first position.

17. The method of claim 16 further comprising adjusting the production tubing responsive to the sensed change in orientation of the first electrical connector such that the first electrical connector is returned to the first position.

18. The method of claim 17 wherein adjusting the powered device further comprises aligning the second electrical connector with the first electrical connector.

19. The method of claim 15 wherein the first position is at an uppermost position on a circumference of the production tubing.

20. The method of claim 15 wherein sensing the change in orientation of the second electrical connector further comprises sensing using an orientation sensor mechanically coupled to the second power connector, and the orientation sensor communicatively coupled to the data acquisition system through the power line.

21. The method of claim 20 wherein the orientation sensor is at least one selected from the group consisting of: an inclinometer; a gyroscope; a three-axis gyroscope; a six-axis gyroscope.

* * * * *